US007647718B2

(12) United States Patent
Burtch

(10) Patent No.: US 7,647,718 B2
(45) Date of Patent: Jan. 19, 2010

(54) MULTI-PANEL FOLD OUT DEVICE, BLANK, AND METHOD OF MAKING THE DEVICE

(76) Inventor: Richard A. Burtch, 85 Moorcrest Drive, Aurora, Ontario (CA) L4G 6C6

( * ) Notice: Subject to any disclaimer, the term of this patent is extended or adjusted under 35 U.S.C. 154(b) by 201 days.

(21) Appl. No.: 12/016,466

(22) Filed: Jan. 18, 2008

(65) Prior Publication Data

US 2009/0183406 A1 Jul. 23, 2009

(51) Int. Cl.
*G09F 1/00* (2006.01)

(52) U.S. Cl. ..... 40/539; 40/492; 40/124.09; 434/81; 446/147

(58) Field of Classification Search ..... 40/539, 40/492, 487, 124.09, 124.11, 124.12; 446/147, 446/148, 487, 488, 79; 434/176, 368, 404, 434/405, 402, 81, 96, 150
See application file for complete search history.

(56) References Cited

U.S. PATENT DOCUMENTS 396,381 A * 1/1889 Yaggy ..... 434/269
1,737,733 A * 12/1929 Scherotto ..... 40/539
3,517,449 A * 6/1970 Frandsen et al. ..... 434/368
4,441,270 A 4/1984 Crowell et al.
2004/0113419 A1 6/2004 Silvestri
2008/0168690 A1 7/2008 Wagenknecht et al.

OTHER PUBLICATIONS

International Search Report and Written Opinion for International Application No. PCT/US2009/031198, Aug. 28, 2009, Korean Intellectual Property Office, Daejeon, Republic of Korea.

* cited by examiner

*Primary Examiner*—Cassandra Davis
(74) *Attorney, Agent, or Firm*—Stites & Harbison PLLC; Ross F. Hunt, Jr.; Jeffrey A. Haeberlin

(57) ABSTRACT

A multi-panel fold-out device made from a blank includes at least first, second, and third panels which are joined together in sequence, and formed by separation lines between the first, second, and third panels. The first and second panels each have an internal panel portion including a score line adjacent to an edge of the panel. Each internal panel portion is releasably secured to its panel such that the internal panel portion can be pivoted around its score line relative to its panel. The first panel is foldable over, along the first separation line, to secure the first panel to the second panel. The first and second panels are foldable under, along the second separation line, to secure the first and second panels to the third panel. The first and second internal panel portions are of different sizes so that these panels can be folded out in sequence.

15 Claims, 6 Drawing Sheets

MULTI-PANEL FOLD OUT DEVICE, BLANK, AND METHOD OF MAKING THE DEVICE

BACKGROUND OF THE INVENTION

1. Field of the Invention

The present invention relates to advertising devices such as self-mailers, and more specifically, to a multi-panel fold-out device formed from a single blank, and to a method of assembling the display device.

2. Description of Prior Art

A multi-panel fold-out device can be used effectively by direct mailers to advertise and market products and services. If such a device can be made interactive with the user or recipient, the device would be more effective. It would also be advantageous for such an interactive multi-panel device to have multiple panels that are capable of easily being folded out in sequence, and to have portions that can readily be torn off or otherwise separated therefrom. Further, important advantages would accrue if the device could be made from a single blank and could be assembled in a simple and inexpensive manner.

SUMMARY OF THE INVENTION

In accordance with embodiments of the invention, there are provided (i) a blank for a multi-panel fold-out device, and (ii) a method for assembling the blank into the device, that afford important advantages over the prior art. In this regard, some important advantages are that the blank, and device made from the blank, are simple and inexpensive to make, and the method of assembly of the device from the blank lends itself to automatic processing, with the attendant benefits of such processing. The device made from the blank enables interactivity with a user and serves as, as will appear, an effective advertisement tool.

According to one aspect of the invention, there is provided a blank for a multi-panel fold-out display device that includes: at least a first, second, and third panels joined together in sequence, and formed by at least a first separation line between the first and second panels and a second separation line between the second and third panels, the first panel having a first internal panel portion including a first score line adjacent to an outer edge of the first panel, the first internal panel being releasably secured to the first panel such that the first internal panel portion can be pivoted around the score line relative to the first panel, the second panel having a second internal panel portion including a second score line adjacent to one edge of the second panel, the second internal panel portion being releasably secured to the second panel such that the second internal panel portion can be pivoted about the second score line relative to the second panel, the first panel being foldable over along the first separation line such that the first panel can be secured to the second panel, and the first and second panels, when secured together, being foldable under along the second separation line, so that the first and second panels can be secured to said the panel, and the first and second internal panel portions being of different sizes.

One important implementation of this aspect of the invention, the blank includes a fourth panel joined together in sequence with the first, second, and third panels, and formed by a third separation line between the third and fourth panels, the third panel including a third internal panel portion including a third score line adjacent to one edge of the third panel, the third internal panel portion being releasably secured to the third panel such that the third internal panel portion can be pivoted about the third score line relative to the third panel, the first, second, and third panels, when secured together, being foldable over along the third separation line, so that the first, second, and third panels can be secured to the fourth panel, and the first, second, and third internal panel portions being of different sizes.

According to another important implementation of this aspect of the invention, the blank includes a fifth panel joined together in sequence with the first, second, third, and fourth panels, and formed by a fourth separation line between the fourth and fifth panels, the fourth panel including a fourth internal panel portion including a fourth score line adjacent to one edge of the fourth panel, the fourth internal panel portion being releasably secured to the fourth panel such that the fourth internal panel portion can be pivoted about the fourth score line relative to the fourth panel, the first, second, third, and fourth panels, when secured together, being foldable over along the fourth separation line, so that the first, second, third, and fourth panels can be secured to the fifth panel, and the first, second, third, and fourth internal panel portions being of different sizes.

In one embodiment, the blank includes microperforations around a perimeter of the internal panel portions for easy removal. Preferably the panels of the blank also include a cutout to facilitate a fold out of the internal panel portions. Advantageously, the internal panel portions are secured to their corresponding panels by at least one microconnector.

According to a further aspect of the invention, there is provided a method of constructing a multi-panel display device from a blank which includes: providing a planar blank, providing separation lines in the blank so as to separate the blank into at least three panels, one of the panels forming a backing panel, forming an internal panel portion with a surrounding panel portion in at least two of the panels using a die cutting operation wherein, for each internal panel portion, one edge thereof is connected to the surrounding panel portion of a corresponding panel by a fold line and remaining edges are releasably secured to the surrounding panel portion, the internal panel portions of the at least two of said panels being of different sizes, applying adhesive to selected portions of at least three of said panels so as to enable at least three of said panels to be joined together, and automatically folding at least three of said panels along said lines of separation so that the adhesive applied to at least three of said panels joins at least three of said panels together, and such that at least two of said panels are secured one on top of the other to the backing panel and the internal panel portions of each of at least two of said panels can be released from the corresponding panels and folded outwardly from the corresponding surrounding panel portions in sequence.

In accordance with yet another aspect of the invention there is provided a method of assembling a multi-panel fold-out display device from a blank, the method comprising the steps of: providing the blank comprising at least first, second and third panels joined together in sequence and formed by at least a first separation line between said first and second panels and a second separation line between said second and third panels, said first panel including a first internal panel portion including a first score line adjacent to an outer edge of said first panel, said first internal panel portion being releasably secured to said first panel such that said first internal panel portion can be pivoted around said first score line relative to said first panel, said second panel having a second internal panel portion including a second score line adjacent to one edge of said second panel, said second internal panel portion being releasably secured to said second panel such that said second internal panel portion can be pivoted about said second score line, and the first and second internal panel portions being of different sizes; folding said first panel over said first separation line onto said second panel and securing said first panel to said second panel along at least one adhesive deposit; and after securing said first panel to said second panel, folding said first and second panels along said second separation line onto said third panel and securing said first and second panels to said third panel along at least one further adhesive deposit.

Further features and advantages of the present invention will be set forth in, or apparent from, the detailed description of preferred embodiments thereof which follows.

BRIEF DESCRIPTION OF THE DRAWINGS

Exemplary embodiments of the invention will now be described by way of example only with reference to the accompanying drawings in which.

DESCRIPTION OF EXEMPLARY EMBODIMENTS OF THE INVENTION

Figure 1:
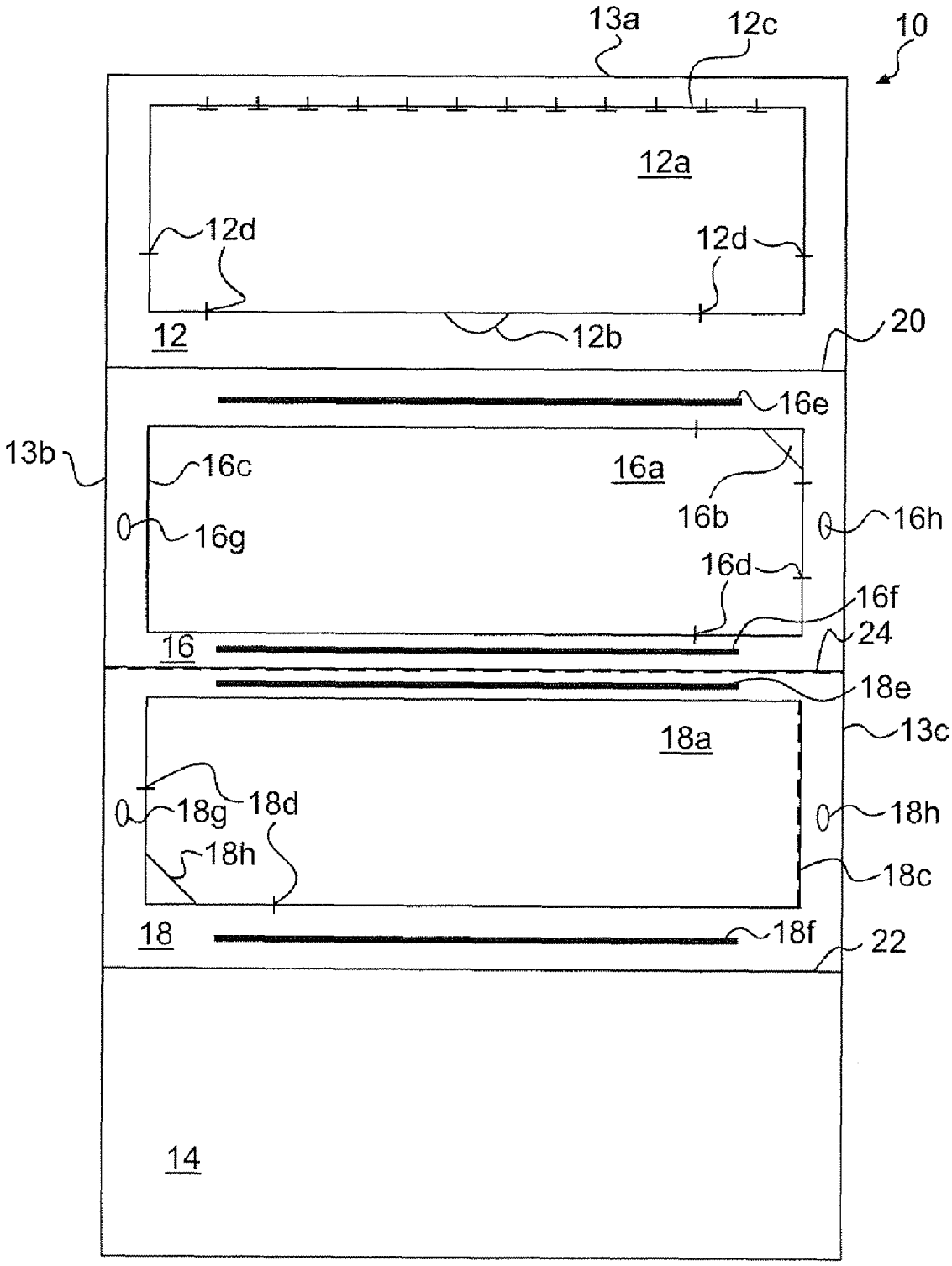
FIG. 1 is top plan view of a blank for a multi-panel fold-out display device according to an exemplary embodiment of the invention.
Figure 2:
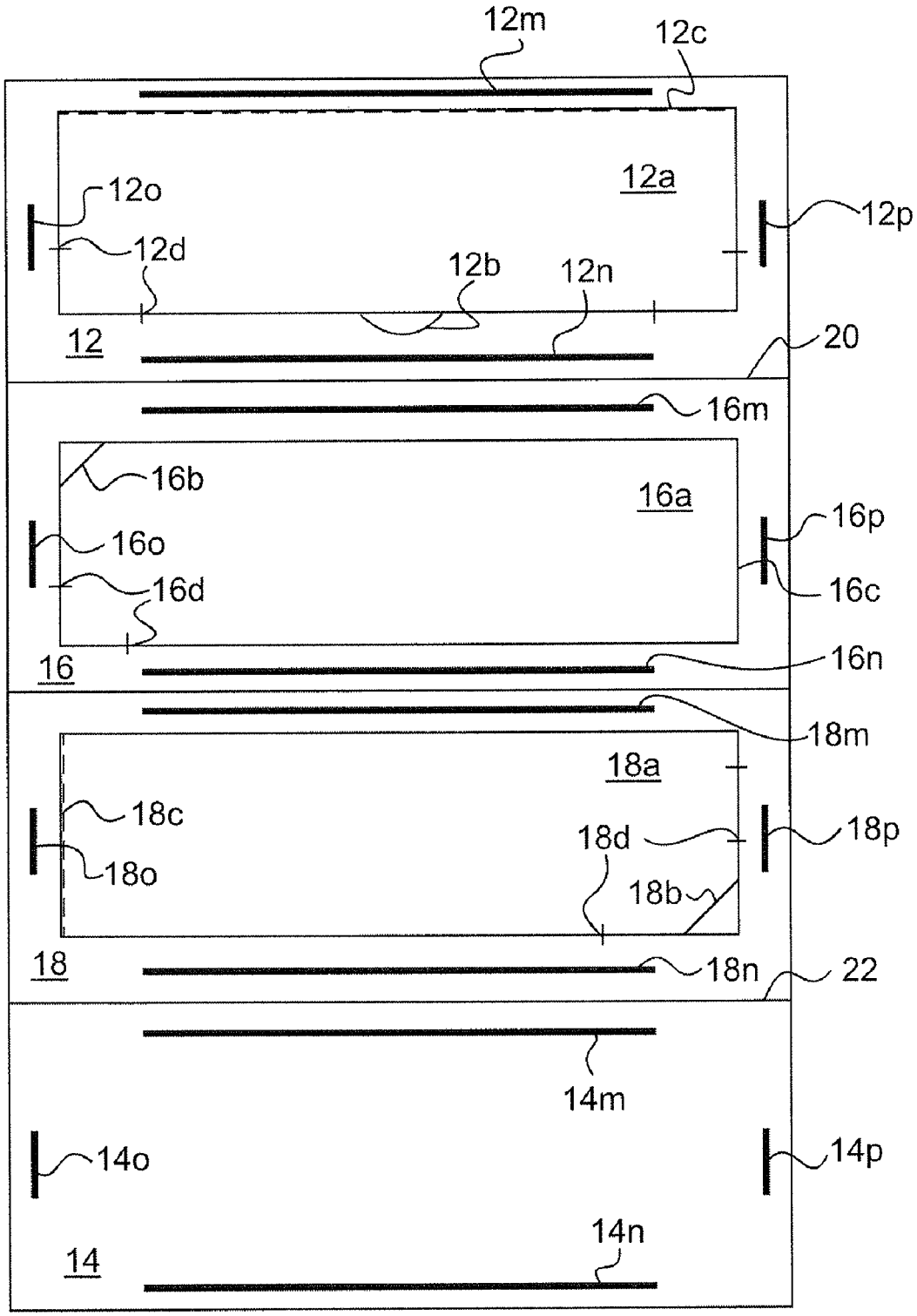
FIG. 2 is a bottom plan view of the blank of FIG. 1.

Referring to FIGS. 1 and 2, there is shown a first preferred embodiment of a blank for a multi-panel fold-out display device in accordance with the invention. The blank, which is generally denoted 10, includes end panels 12 and 14, and intermediate panels 16 and 18. It will be appreciated that because FIGS. 1 and 2 respectively show the top (front) and bottom (back) sides of the blank 10, the sequence of the panels is reversed in the two figures. It will also be understood that the words front and back, left and right, and top and bottom, are merely referenced to the blank, and that the orientation of the blank could be changed from that shown. Moreover, the "intermediate" panels can be located at the ends of the blank and the "end" panels at the intermediate locations.

The blank 10 is made of paper, cardboard, paperboard, or laminates of the same, and is hereinafter referred to as being made of paperboard.

The end panels 12 and 14, which form the outside or cover panels in the assembled device, are generally rectangular in shape and include score lines or lines of weakness 20 and 22. End panel 14 serves as a backing panel. The end panels 12 and 14 are joined to respective intermediate panels 16 and 18 by the respective score lines 20 and 22. It is noted that because of the thickness of the paperboard used in this embodiment, the use of a score line, wherein a line is cut into the paperboard to form a foldable hinge, is preferred, although different fold lines can be employed depending on the application, the type of paper used, the paper thickness, and the like. A reversed score line or microperforated line 24 joins (i.e., separates) panels 16 and 18. Score line 24 is intended to ultimately form a separation line between panels 16 and 18, i.e., a line along which panels 16 and 18 may be separated.

The first end panel 12 includes a rectangular inner or internal panel portion 12*a*, i.e., a panel or portion that is surrounded on four sides by the remainder of the panel 12, and a semi-circular cutout 12*b*. The internal panel portion 12*a* includes a reversed score line or microperforated line 12*c* located adjacent to and parallel with the outer top edge 13*a* of the end panel 12 to allow the internal panel portion 12*a* to be folded out or pivoted around the score line 12*c* once the device is assembled from the blank 10. Further, at least one small connector element or microperforated portion 12*d* is provided between adjacent parts of the other three sides of the first end panel 12 and the internal panel portion 12*a*, (also referred to as a panel attachment microconnector), so that the internal panel portion 12*a* is releasably attached or secured to the first end panel 12. The microperforated portions 12*d* preferably comprise a series of very small connecting elements or microconnectors made of the paperboard that releasably secure one section of the paperboard with another adjacent section of the paperboard. In this specific embodiment, a very small connecting element or microconnector 12*d* is provided on either side of the cutout 12*b* and on the left and right sides of the internal panel portion 12*a*. The microconnectors 12*d* releasably secure the internal panel portion 12*a* to the first end panel 12.

The first intermediate panel 16 includes a rectangular internal panel portion 16*a* and a triangular cutout 16*b*. The internal panel portion 16*a* has a score line 16*c* adjacent to and parallel with the left edge 13*b* of the panel 16. Further, at least one microperforated portion 16*d* similar to that described above is provided between the first intermediate panel 16 and the internal panel portion 16*a*, with each portion 12*d* comprising at least one panel attachment element or microconnector, so that the internal panel portion 16*a* is releasably secured or attached to the first intermediate panel 16. Elongate glue deposits or lines 16*e* and 16*f* of a suitable glue or other adhesive extend along and are spaced laterally from the internal panel portion 16*a* on opposite sides thereof, and two further adhesive spots 16*g* and 16*h*, made of a similar glue or other adhesive, are provided at opposite ends of the internal panel portion 16*a*.

The second intermediate panel 18 also includes a rectangular internal panel portion 18*a* and a triangular cutout 18*b*. The internal panel portion 18*a* has a reversed score line or microperforated line 18*c* adjacent to and parallel with the outer edge 13*c* of the panel 18. Further, at least one microperforated portion 18*d* is provided between the second intermediate panel 18 and the internal panel portion 18*a*, with each portion 16*d* comprising at least one panel attachment element or microconnector, so that the internal panel portion 18*a* is releasably secured or attached to the second intermediate panel 18. Elongate glue deposits 18*e* and 18*f* extend along and are spaced laterally from the internal panel portion 18*a* on opposite sides thereof, and two further adhesive spots 18*g* and 18*h* are provided at opposite ends of the internal panel portion 18*a*.

It is important to note that the internal panel portion 18*a* of second intermediate panel 18 is smaller than the internal panel portion 16*a* of the first intermediate panel 16, and that the latter is smaller than the internal panel portion 12*a* of the first end panel 12. In this manner, once the multi-panel fold-out display device is assembled, the internal panel portion 12*a* can be folded outwardly, then the first internal panel portion 16*a* can be folded outwardly, and thereafter the internal panel portion 18*a* can be folded outwardly, all without any of the panel portions 12*a*, 16*a*, 18*a* obstructing each other.

Further, it will be understood that the internal panel portion 12*a*, 16*a*, and 18*a* are not limited to rectangular shapes.

FIG. 2 shows the rear (bottom) of the blank 10 and, as illustrated, the first panel 12 has two elongate adhesive, e.g., glue deposits 12*m* and 12*n* extending along and spaced laterally from the internal panel portion 12*a* on opposite sides thereof, and two further adhesive deposits or spots 12*o* and 12*p* are provided at opposite ends of the internal panel portion 12*a*. Similarly, the first intermediate panel 16 has elongate glue deposits 16*m* and 16*n* extending along and spaced laterally from the internal panel portion 16*a* on opposite sides thereof, and two further adhesive spots 16*o* and 16*p* are provided at opposite ends of the internal panel portion 16*a*. Further, the second intermediate panel 18 has elongate glue deposits 18*m* and 18*n* extending along and spaced laterally from the internal panel portion 18*a* on opposite sides thereof, and two further adhesive spots 18*o* and 18*p* at opposite ends of the internal panel portion 18*a*. Second panel 14 has elongate glue deposits 14*m* and 14*n* extending along and spaced laterally from the top and bottom of the panel 14 on opposite sides thereof, and two further adhesive spots 14*o* and 14*p* at opposite ends of the panel 14.

As described above, and as can be seen in FIG. 2, the blank 10 is comprised of the panels 12, 16, 18, and 14 joined together in sequence and formed by respective separation lines located between every two panel joined together.

Figure 3A:
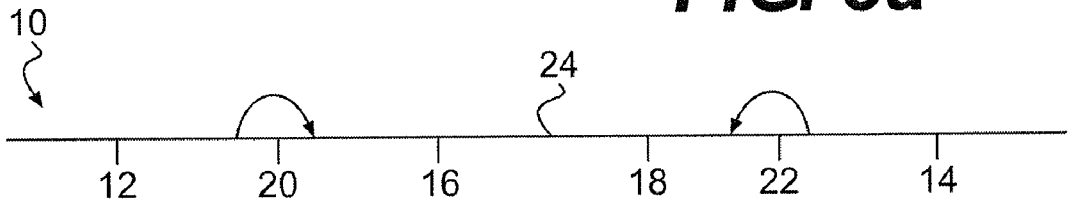
FIGS. 3*a*-3*c* are a series of side elevational views, illustrating subsequential steps in the assembly of the blank of FIG. 1 into a multi-panel fold-out display device.
Figure 3B:
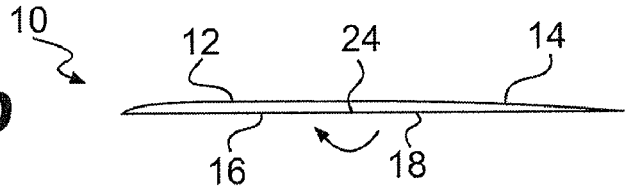
Figure 3C:
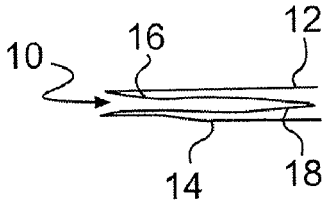
Figure 4A:
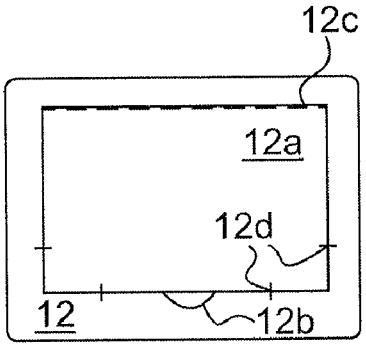
FIGS. 4*a*-4*d* are a series of top plan views of the multi-panel fold-out display device of FIGS. 3*a*-3*c*, showing different presentations of the panels.
Figure 4B:
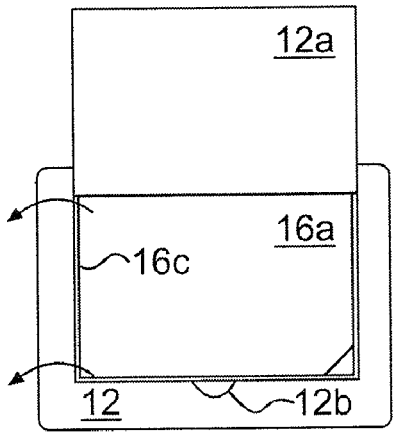
Figure 4C:
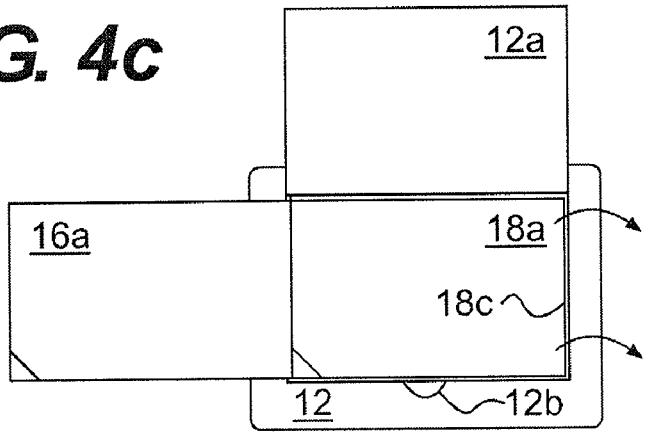
Figure 4D:
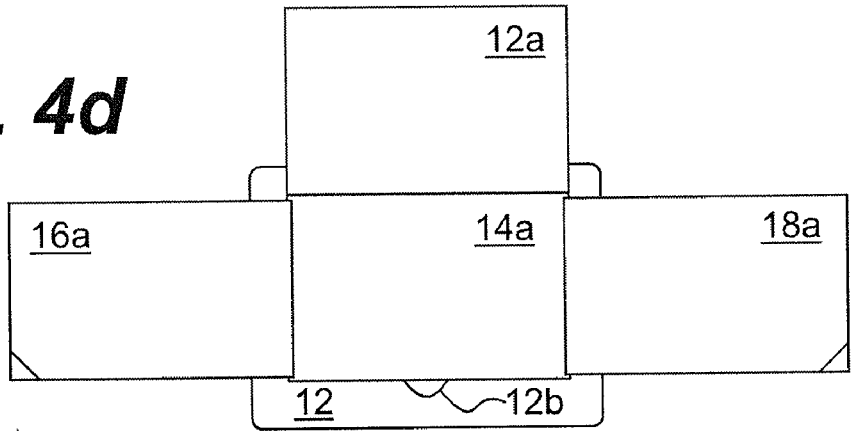

FIGS. 3*a*-3*c* show two steps in the assembly of the exemplary blank 10 into the multi-panel fold-out display device. Initially, the first and second end panels 12 and 14 are folded over, along respective score lines 20 and 22 on top of intermediate panels 16 and 18. In this step, the end panel 12 is glued to the adjacent intermediate panel 16 such that elongate glue deposit 12*m* is on or adjacent elongate glue deposit 16*n*, elongate glue deposit 12*n* is on or adjacent elongate glue deposit 16*m*, while adhesive spot 12*o* is on or adjacent adhesive spot 16*o*, and adhesive spot 12*p* is on or adjacent adhesive spot 16*p*. Similarly, the end panel 14 is glued to adjacent intermediate panel 18 such that elongate glue deposit 14*m* is on or adjacent elongate glue deposit 18n, elongate glue deposit 14*n* is on or adjacent elongate glue deposit 18*m*, while adhesive spot 14*o* is on or adjacent adhesive spot 18*o*, and adhesive spot 14*p* is on or adjacent adhesive spot 18*p*.

The next step involves folding over the glued intermediate panels 16 and 18 along score line 24 such that the end panels 12 and 14 are on the exterior while the intermediate panels 16 and 18 are sandwiched inside the end panels 12 and 14. In this step, the panel 16 is glued to panel 18 such that elongate glue deposit 16*e* is on or adjacent elongate glue deposit 18*f*, elongate glue deposit 16*f* is on or adjacent elongate glue deposit 18*e*, while adhesive spot 16*g* is on or adjacent adhesive spot 18*g*, and adhesive spot 16*h* is on or adjacent adhesive spot 18*h*.

It should be noted that the order of the steps of assembly is illustrative and represents one method of assembly. Other methods of assembly may be employed and some other methods are considered below.

FIGS. 4*a*-4*d* show the assembled multi-panel fold-out display device in use. In this embodiment, once assembled, the panels 12, 16, and 18 are secured or joined together to the backing panel 14. Also, the internal panel portions 12*a*, 16*a*, and 18*a* are releasably connected to panels 12, 16, and 18 with easily removable or releasable microconnectors 12*d*, 16*d*, and 18*d*, so that the panel portions 12*a*, 16*a*, and 18*a* fold outwardly. The panels 12, 14, 16, and 18 and the panel portions 12*a*, 16*a*, and 18*a* can include information such as advertising copy or photographs. The cutouts 12*b*, 16*b*, and 18*b* facilitate a fold out of the corresponding inner panel portions 12*a*, 16*a*, and 18*a* in sequence.

In the embodiment illustrated, a "tri-panel" fold-out device is provided, i.e., a device wherein three integral panel portions 12*a*, 16*a* and 18*a* fold out. By providing that the internal panel portion 12*a*, 16*a*, and 18*a* fold outwardly from the corresponding surrounding panels 12, 16, and 18, there is interaction between the multi-panel fold-out device and the user. For example, each of the internal panel portions can contain related information, and the information can be such that the message delivered thereby builds as the panels fold out in sequence.

In an important embodiment, internal panel portions 12*a*, 16*a*, or 18*a* have microperforations around the entire perimeter of each respective panel portions 12*a*, 16*a*, and 18*a*, i.e., in place of the score lines for enabling folding out of the respective panel portion, so that any or all of the internal panel portion 12*a*, 16*a*, or 18*a* can be easily removed. In this way, the internal panel portions can serve as reply cards and/or coupons. Because the internal panel portion 12*a*, 16*a*, and 18*a* are secured in place with microconnectors 12*d*, 16*d*, and 18*d*, the assembled device can also be used, for example, in an instant win sweepstakes game, wherein, for example, a winning number is provided on the innermost inner panel portion and the other panel portions contain advertisements that are presented prior to reaching the innermost panel portion. In addition, the multi-panel fold-out device can be used as a self-mailer wherein the multiple internal panel portions 12*a*, 16*a* and 18*a* contain advertising, photographs, or the like or function as reply cards, coupons, sweepstakes, tickets, or the like with which a user can interact. To this end, one of the end panels 12 or 14 can have a prescribed location at which address information and postage can be placed or entered.

It should be noted that for each of the panel constructions described above, a method of assembly can be used wherein the end panels and the intermediate panels are folded and glued in an accordion manner such that the front of an end panel is folded over and secured or joined with adhesive to the front of the adjacent intermediate panel, followed by having the rear of that intermediate panel folded under and secured or joined with adhesive to the rear of the adjacent panel. The folding and securing or joining process, which is preferably carried out automatically, is repeated in a similar over/under manner until all the panels are folded and secured together or joined.

It will be understood from the foregoing that the multi-panel fold-out display device is not limited to construction employing the two end panels and two intermediate panels discussed above. For example, in another embodiment a multi-panel fold-out display device design having two end panels and one intermediate panel is provided (which can be referred to as a bi-panel fold-out display device), while in another embodiment, a multi-panel fold-out design having two end panels and three intermediate panels is provided (which is referred to herein as a quad-panel fold-out display device). For a display device with two end panels and one intermediate panel, the first end and intermediate panels are similar to those of the tri-panel display device described above. The other end or backing panel would correspond to the second intermediate panel described above. For a bi-panel fold-out display device, the first end and intermediate panels would have internal panel portions that fold outwardly and, in some embodiments, are removable.

For a multi-panel fold-out display device having two end panels and three intermediate panels (the so-called quad-panel fold-out display device), the basic construction is the same. In this embodiment, the backing or end panel for the tri-panel display device described above is the third intermediate panel, as is further described below in connection with FIG. 6.

Figure 5:
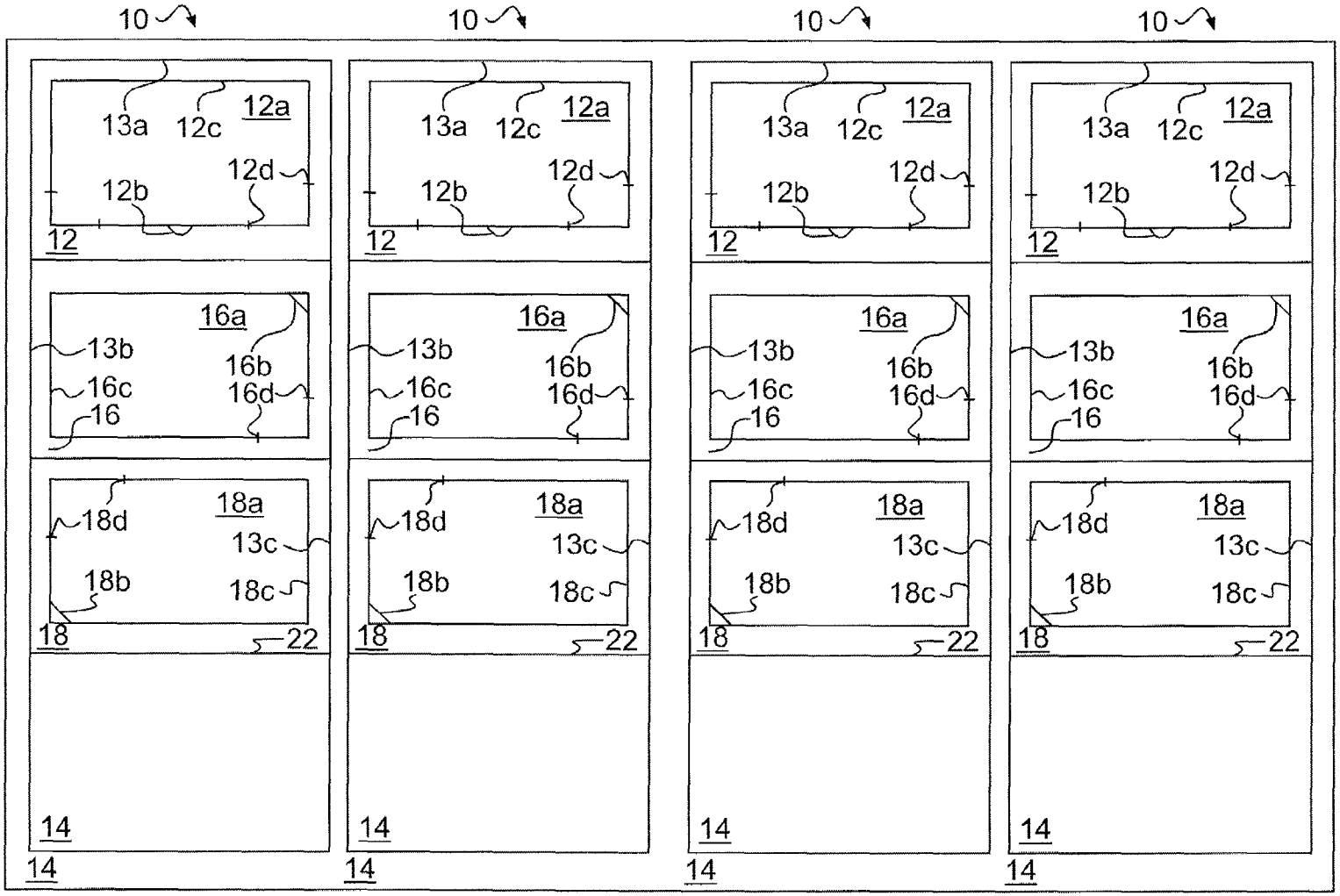
FIG. 5 is a top plan view of a single sheet for making a plurality of exemplary blanks of FIG. 1.

FIG. 5 shows a single sheet made of paperboard or the like for making a plurality of blanks 10. In this embodiment, the sheet is illustrated having four tri-panel fold-out blanks 10. In accordance with an important aspect of the invention, the blanks 10 including all the necessary score lines, perforations, and adhesive areas described above are provided automatically, and preferably, substantially simultaneously, so as to significantly reduce manufacturing time and costs. It will of course, be understood, that other types of blanks (e.g., for a bi-panel fold-out device, quad-panel fold-out device, or other such devices) can be similarly made. After the blanks 10 are made, folding of the individual fold-outs along with the glue deposits as described above is carried out automatically to assemble each fold-out display device.

Figure 6:
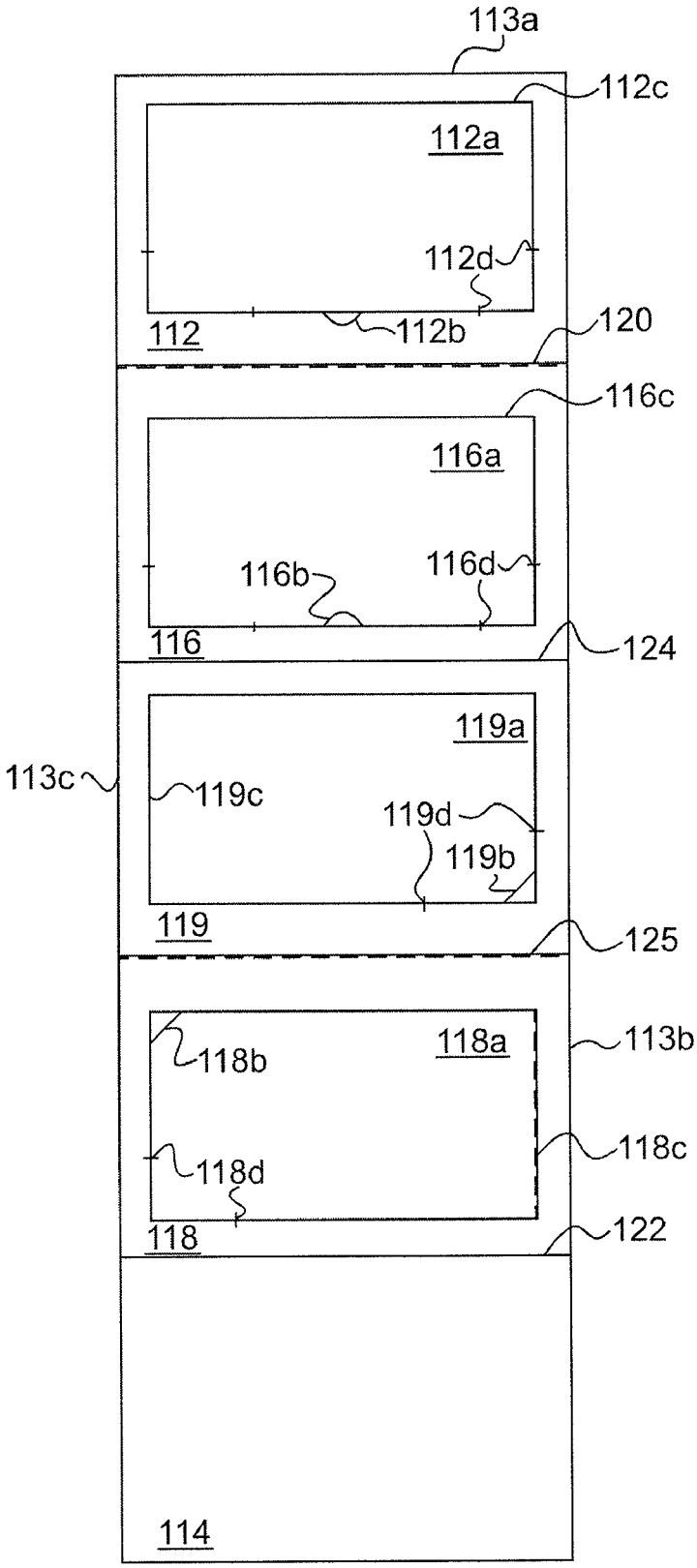
FIG. 6 is a top plan view of a blank for a multi-panel fold-out display device according to another exemplary embodiment of the invention.

Turning now to FIG. 6, there is shown a preferred embodiment of a blank for a quad-panel fold-out display device. The blank, which is generally denoted 110, includes end panels 112 and 114, and intermediate panels 116, 118, and 119.

The end panels 112 and 114 are joined to respective intermediate panels 116 and 118 by respective reverse score line or microperforated line 120 and score line 122. Intermediate panels 116 and 118 are joined to intermediate panel 119 by score line 124 and reversed score line 125, respectively. As discussed above, a score line is preferred to form a foldable hinge, although different fold lines can be used as well.

The first end panel 112 includes a rectangular internal panel portion 112*a*, i.e., a panel or portion that is surrounded on four sides by the remainder of the panel 112, and a semi-circular cutout 112*b*. The internal panel portion 112*a* includes a score line 112*c* located adjacent to and parallel with the outer top edge 113*a* of the end panel 112 to allow the internal panel portion 112*a* to be folded out or pivoted around the score line 112*c* once the device is assembled from the blank 110. Further, at least one microperforated small connector element or portion (also referred to as a panel attachment microconnector) is provided between the first end panel 112 and the internal panel portion 112*a*, so that the internal panel portion 112*a* is releasably attached or secured to the first end panel 112. In this specific embodiment, there is a microconnector 112*d* on either side of the cut out 112*b* and on the left and right sides of the internal panel portion 112*a* to releasably secure the internal panel portion 112*a* to the first end panel 112.

The first intermediate panel 116 includes a rectangular internal panel portion 116*a* and a semi-circular cutout 116*b*. The internal panel portion 116*a* has a reversed score line 116*c* adjacent to and parallel with the outer top edge or score line 120 of the panel 116. Further, there is at least one microperforated portion 116*d*, similar to that described above between the first intermediate panel 116 and the internal panel portion 116*a*, with each portion 116*d* forming at least one panel attachment element or microconnector, so that the internal panel portion 116*a* is releasably secured or attached to the first intermediate panel 116. The adhesive deposits (i.e., elongate glue deposits or lines and adhesive spots) shown in FIGS. 1 and 2 have been eliminated to simplify the drawing in FIG. 6, but similar adhesive deposits would be used.

The second intermediate panel 118 includes a rectangular internal panel portion 118*a* and a triangular cutout 118*b*. The rectangular internal panel portion 118*a* has a reversed score line or microperforated line 118*c* adjacent to and parallel with the outer right edge 113*b* of the panel 118. Further, there is at least one microperforated portion 118*d* between the second intermediate panel 118 and the rectangular internal panel portion 118*a*, with each portion 118*d* forming at least one panel attachment element or microconnector, so that the rectangular internal panel portion 118*a* is releasably secured or attached to the second intermediate panel 118. Similar adhesive deposits as discussed above would be used.

The third intermediate panel 119 is located between the first and second intermediate panels 116 and 118 and includes a rectangular internal panel portion 119*a* and a triangular cutout 119*b*. The internal panel portion 119*a* has a score line 119*c* adjacent to and parallel with the outer left edge 119*c* of the panel 119. Further, there is at least one microperforated portion 119*d* between the third intermediate panel 118 and the internal panel portion 119*a*, with each portion 119*d* forming a panel attachment element or microconnector so that the internal panel portion 119*a* is releasably secured or attached to the third intermediate panel 119. Similar adhesive deposits as discussed above would be used.

Similarly to what was described above with respect to FIGS. 1 and 2, the internal panel portions 112*a*, 116*a*, 119*a*, and 118*a* are of slightly decreasing size in descending order as listed. In other words, panel portion 112*a* is slightly larger than panel portion 116*a*, panel portion 116*a* is slightly larger than panel 119*a*, and so on, with 118*a* being the smallest and 112*a* being the largest of the panel portions 112*a*, 116*a*, 119*a*, and 118*a*. In this manner, once the quad-panel fold-out display device is assembled, the internal panel portion 112*a* can be folded outwardly, then the internal panel portion 116*a* can be folded outwardly, then the internal panel portion 119*a* can be folded outwardly, and then the rectangular internal panel portion 118*a* can be folded outwardly, all in sequence and all without obstructing each other.

As above, the internal panel portions 112*a*, 116*a*, 119*a*, and 118*a* are not limited to rectangular shapes. In addition, each of the internal panel portion 112*a*, 116*a*, 119*a*, and 118*a* can have a plurality of microperforations placed around the full perimeter of each respective panel portions 112*a*, 116*a*, 119*a*, and 118*a*, in place of having score lines, so that any or all of the internal panel portions 112*a*, 116*a*, 119*a*, and 118*a* can be completely removed from the remainder of the device.

The quad-panel fold-out display device is assembled in an accordion style as was discussed above with respect to the tri-panel fold-out display device. More specifically, the first end panel 112 is initially folded over along line 120 and secured to the first intermediate panel 116. Next, the combined panels 112 and 116 are folded under along line 124 and secured to the third intermediate panel 119. Then, the combined panels 112, 116, and 119 are folded over along line 125 and secured to the second intermediate panel 118. Lastly, the combined panels 112, 116, 119, 118 are folded under along line 122 and secured to the second end panel 114.

It will, of course, be appreciated that the same uses described above for the quad-panel and bi-panel fold-out display devices can be put to the tri-panel fold-out display device and that even more panels can be provided as described.

Although the invention has been described above in relation to exemplary embodiments thereof, it will be understood by those skilled in the art that variations and modifications can be effected in these exemplary embodiments without departing from the scope and spirit of the invention.

What is claimed is:

1. A blank for a multi-panel fold-out display device, the blank comprising:

at least first, second and third panels joined together in sequence, and formed by at least a first separation line between said first and second panels and a second separation line between said second and third panels;

said first panel including a first internal panel portion including a first score line adjacent to an outer edge of said first panel, said first internal panel portion being releasably secured to said first panel such that said first internal panel portion, when released, can be pivoted around said first score line relative to said first panel;

said second panel having a second internal panel portion including a second score line adjacent to an outer edge of said second panel, said second internal panel portion being releasably secured to said second panel such that said second internal panel portion, when released, can be pivoted about said second score line relative to said second panel;

said first panel being foldable over along said first separation line such that said first panel can be secured to said second panel, and said first and second panels, when secured together, being foldable under along said second separation line so that said first and second panels can be secured to said third panel; and said first and second internal panel portions being of different sizes.

2. The blank of claim 1, further comprising:

a fourth panel joined together in sequence with said first, second, and third panels, and formed by a third separation line between said third and fourth panels;

said fourth panel including a third internal panel portion including a third score line adjacent to one edge of said fourth panel, said third internal panel portion being releasably secured to said fourth panel such that said third internal panel portion can be pivoted about said third score line relative to said fourth panel;

said first, second, and fourth panels, when secured together, being foldable over along said third separation line, so that said first, second, and fourth panels can be secured to said third panel; and said first, second, and third internal panel portions being of different sizes.

3. The blank of claim 2, wherein said third internal panel portion includes microperforations around a perimeter thereof for enabling separation of said third internal panel portion from said fourth panel.

4. The blank of claim 2, wherein said third internal panel portion defines a cutout for facilitating fold out of said third internal panel portion.

5. The blank of claim 2, wherein said third internal panel portion is secured to said fourth panel by at least one microconnector.

6. The blank of claim 2, wherein said third internal panel portion is smaller than said second internal panel portion, and said second internal panel portion is smaller than said first internal panel portion.

7. The blank of claim 2, wherein said first, second and third internal panel portions fold out in different directions.

8. The blank of claim 2, further comprising:

a fifth panel joined together in sequence with said first, second, third, and fourth panels, and formed by a fourth separation line between said fourth and fifth panels;

said fifth panel including a fourth internal panel portion including a fourth score line adjacent to one edge of said fifth panel, said fourth internal panel portion being releasably secured to said fifth panel such that said fourth internal panel portion can be pivoted about said fourth score line relative to said fifth panel;

said first, second, fourth, and fifth panels, when secured together, being foldable over along said fourth separation line, so that said first, second, fourth, and fifth panels can be secured to said third panel; and said first, second, third, and fourth internal panel portions being of different sizes.

9. The blank of claim 1, wherein said first internal panel portion includes microperforations around a perimeter thereof for enabling separation of said first internal panel portion from the first panel.

10. The blank of claim 1, wherein said second internal panel portion includes microperforations around a perimeter thereof for enabling separation of said second internal panel portion from the second panel.

11. The blank of claim 8, wherein said fourth internal panel portion includes microperforations around a perimeter thereof for enabling separation of said fourth internal panel portion from the fifth panel.

12. The blank of claim 1, wherein said first panel includes a cutout for facilitating folding out of said first internal panel portion.

13. The blank of claim 1, wherein said second internal panel portion includes a cutout, for facilitating folding out of said second internal panel portion.

14. The blank of claim 1, wherein said second internal panel portion is secured to said second panel by at least one microconnector.

15. The blank of claim 1 wherein said first and second internal panel portions fold out in different directions.

* * * * *